US009546485B2

(12) United States Patent
Mills et al.

(10) Patent No.: US 9,546,485 B2
(45) Date of Patent: Jan. 17, 2017

(54) ROOF CURB

(71) Applicant: Standard Sheet Metal, Inc., Kansas City, MO (US)

(72) Inventors: Derek M. Mills, Lee's Summit, MO (US); Brian H. Blackmore, Kansas City, MO (US)

(73) Assignee: Standard Sheet Metal, Inc., Kansas City, MO (US)

( * ) Notice: Subject to any disclaimer, the term of this patent is extended or adjusted under 35 U.S.C. 154(b) by 0 days.

(21) Appl. No.: 14/875,026

(22) Filed: Oct. 5, 2015

(65) Prior Publication Data

US 2016/0024798 A1 Jan. 28, 2016

Related U.S. Application Data

(63) Continuation of application No. 14/072,289, filed on Nov. 5, 2013, now Pat. No. 9,151,057.

(51) Int. Cl.

| | |
|---|---|
| ***E04D 1/36*** | (2006.01) |
| ***E04D 13/147*** | (2006.01) |
| ***E04D 13/03*** | (2006.01) |
| ***E04B 1/64*** | (2006.01) |
| ***E04B 1/66*** | (2006.01) |
| ***E04B 7/18*** | (2006.01) |

(52) U.S. Cl.

CPC ..... *E04D 13/1475* (2013.01); *E04B 1/64* (2013.01); *E04B 1/66* (2013.01); *E04B 7/18* (2013.01); *E04D 13/0315* (2013.01); *E04D 13/031* (2013.01)

(58) Field of Classification Search

CPC ..... E04D 13/1475; E04D 13/0315; E04D 13/031; E04B 7/18; E04B 1/66; E04B 1/64

USPC ..... 52/58, 60, 200, 282.2

See application file for complete search history.

(56) References Cited

U.S. PATENT DOCUMENTS

| | | | | | |
|---|---|---|---|---|---|
| 4,559,753 | A | * | 12/1985 | Brueske | E04D 13/031 52/200 |
| 4,972,638 | A | * | 11/1990 | Minter | E04D 13/1475 52/200 |
| 5,027,576 | A | * | 7/1991 | Gustavsson | E04D 13/1475 52/200 |
| 5,647,175 | A | * | 7/1997 | Smyth | E04D 13/0315 52/1 |
| 5,806,255 | A | * | 9/1998 | Verby | E04D 13/0315 52/200 |
| 6,067,759 | A | * | 5/2000 | House | E04D 13/0315 52/198 |
| 6,151,838 | A | * | 11/2000 | Husein | E04D 13/1475 52/200 |
| D489,834 | S | * | 5/2004 | Weston | E04D 13/1475 D25/199 |

(Continued)

*Primary Examiner* — Basil Katcheves
*Assistant Examiner* — Joshua Ihezie
(74) *Attorney, Agent, or Firm* — Hovey Williams LLP

(57) ABSTRACT

A curb assembly is provided for mounting on a sloped, standing seam metallic roof, in order to provide support for a roof fixture, such as an exhaust fan or skylight. The curb assembly includes a box-like structure mounted atop the roof in surrounding relationship to a roof opening. The curb assembly further includes an underlying, below-roof frame assembly. Specialized upper and lower end connection structure serves to securely mount the curb assembly to the metal roof.

20 Claims, 8 Drawing Sheets

(56) References Cited

U.S. PATENT DOCUMENTS

| | | | | |
|---|---|---|---|---|
| 7,296,388 | B2 * | 11/2007 | Valentz | E04D 13/0305 52/200 |
| 7,308,777 | B2 * | 12/2007 | Sandow | E04D 13/0305 52/200 |
| 7,712,279 | B2 * | 5/2010 | McClure | E04D 13/0315 52/200 |
| 9,151,057 | B2 * | 10/2015 | Mills | E04D 13/1475 |
| 2007/0094984 | A1 * | 5/2007 | McClure | E04D 13/0315 52/580 |
| 2008/0040993 | A1 * | 2/2008 | Valentz | E04D 13/0315 52/200 |
| 2011/0309545 | A1 * | 12/2011 | Valentz | E04D 13/0305 264/255 |

* cited by examiner

ROOF CURB

CROSS-REFERENCE TO RELATED APPLICATIONS

This is a continuation of U.S. application Ser. No. 14/072,289, filed Nov. 5, 2013, entitled ROOF CURB, which is hereby incorporated in its entirety by reference herein.

BACKGROUND OF THE INVENTION

1. Field of the Invention

The present invention is broadly concerned with improved, prefabricated curb assemblies designed to be mounted on standing seam roofs (which are traditionally formed of metal). More particularly, the invention pertains to the curb assemblies and overall roof constructions with curb assemblies mounted thereon. The curb assemblies are specially designed for rapid and easy field installation, while providing a rigid, water-tight, peripherally sealed construction.

2. Description of the Prior Art

Roof curb assemblies have been in use for many years for the purpose of mounting roof fixtures, such as exhaust fans, skylights, or air conditioning components. Generally speaking, these curb assemblies include upstanding box walls, which are secured to the underlying roof and in surrounding relationship to an opening formed in the roof and associated with the mounted fixture. In some instances, roof curb assemblies are of modular design and are constructed on site, see, e.g., U.S. Pat. No. 7,065,928. In other instances, prefabricated roof curb assemblies have been provided, which require no field assembly.

In many industrial applications, standing seam sloped metal roofs are deemed optimum. These roofs are made up of a series of elongated, side-by-side, interconnected panels and present a higher end and a lower end for water drainage. In the construction of these roofs, the panels are first placed in adjacency with the elongated side marginal standing seam components in close proximity. Thereupon, a seaming device is used to form laps or other types of joints by appropriate joining of the seam components. These joints can take a number of forms, e.g., simple overlaps, single or double locks, tees, snap locks, battens, or trapezoidal laps, see, e.g., http://www.nrca.net/roofing/Metal-roof-systems-for-steep-slope-applications-901.

Curb assemblies for standing seam metal roofs must be specially configured in order to accommodate the standing seams, because in many instances, the necessary roof openings have a lateral dimension which crosses one or more of the seams. Moreover, the curb assemblies must be easily installed in the field and designed eliminate or minimize leakage around the assemblies.

SUMMARY OF THE INVENTION

The present invention overcomes the problems outlined above and provides a greatly simplified and easily installed curb assembly.

According to one aspect of the present invention a roof construction includes a sloped roof comprising a series of side-by-side panels interconnected along substantially parallel standing seams. The roof presents a higher end and a lower end whereby water will drain from the roof and off the lower end thereof. An opening is formed in the roof and has a lateral dimension transverse to the standing seams so as to cross at least one of the standing seams. The roof construction further includes an integrally formed, prefabricated curb assembly located in surrounding relationship to the opening and operable to support a roof fixture. The curb assembly includes upright, interconnected walls including a pair of opposed sidewalls, a higher end lateral wall, and a lower end lateral wall. The curb assembly also includes higher end connection structure extending at least in part from the bottom margin of the higher end lateral wall and including a plate having an upstanding cap in substantial mating, covering relationship to the at least one standing seam. An end plate covers the lower end of the cap. The curb assembly further includes a water diverter extending between the plate and the outer surface of the higher end lateral wall and being configured to divert water laterally away from the curb assembly. Finally, the curb assembly includes lower end connection structure comprising a cap section in mating, covering relationship to the at least one standing seam at the lower end of the curb assembly. The cap section is located adjacent the bottom margin of said lower end lateral wall, there being an opening formed in said lower end lateral wall in registry with the cap section in order to receive the at least one standing seam.

According to another aspect of the present invention, an integrally formed, prefabricated curb assembly is provided. The curb assembly is operable to surround an opening formed in a sloped roof, wherein the roof comprises a series of side-by-side panels interconnected along substantially parallel standing seams. The roof presents a higher end and a lower end whereby water will drain from the roof and off the lower end thereof. The roof opening has a lateral dimension transverse to the standing seams and crosses at least one of the standing seams. The curb assembly includes upright, interconnected walls including a pair of opposed sidewalls, a higher end lateral wall, and a lower end lateral wall. The curb assembly further includes higher end connection structure extending at least in part from the bottom margin of the higher end lateral wall and including a plate having an upstanding cap configured for substantial mating, covering relationship with the at least one standing seam. An end plate covers the lower end of the cap. The curb assembly also includes a water diverter extending between the plate and the outer surface of the higher end lateral wall and being configured to divert water laterally away from the curb assembly. Finally, the curb assembly includes lower end connection structure comprising a cap section configured for mating, covering relationship with the at least one standing seam at the lower end of the curb assembly. The cap section is located adjacent the bottom margin of the lower end lateral wall. There is an opening formed in the lower end lateral wall in registry with the cap section in order to receive the at least one standing seam.

In preferred forms, the roof standing seams are generally trapezoidal in cross-section, and the caps and cap sections are configured to overlie and mate with the standing seam ends. Each of the seam caps includes a pair of opposed, upwardly extending, converging bottom sections and an upper cover section spanning the bottom sections and welded thereto. The overall curb assembly also preferably includes a generally quadrate metallic frame adjacent the underside of the metal roof and in general alignment with components of the curb assembly. Threaded connectors are preferably used to securely mount the curb assembly to the roof.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWINGS

Preferred embodiments of the present invention are described in detail below with reference to the attached drawing figures, wherein.

Figure 1:
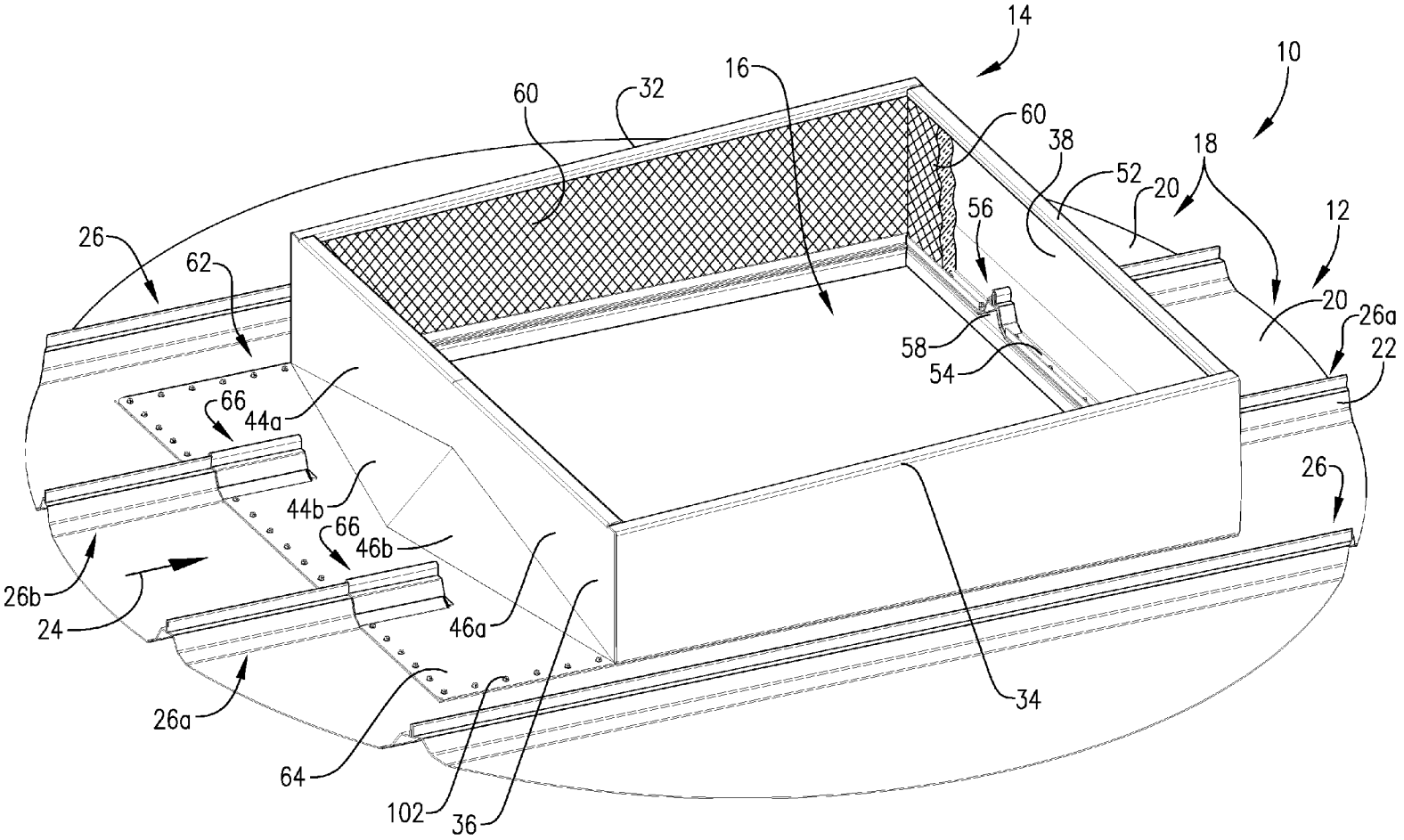
FIG. 1 is a perspective view with parts broken away of an installed roof curb assembly constructed in accordance with a preferred embodiment of the present invention, illustrating the higher end of the curb.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 2:
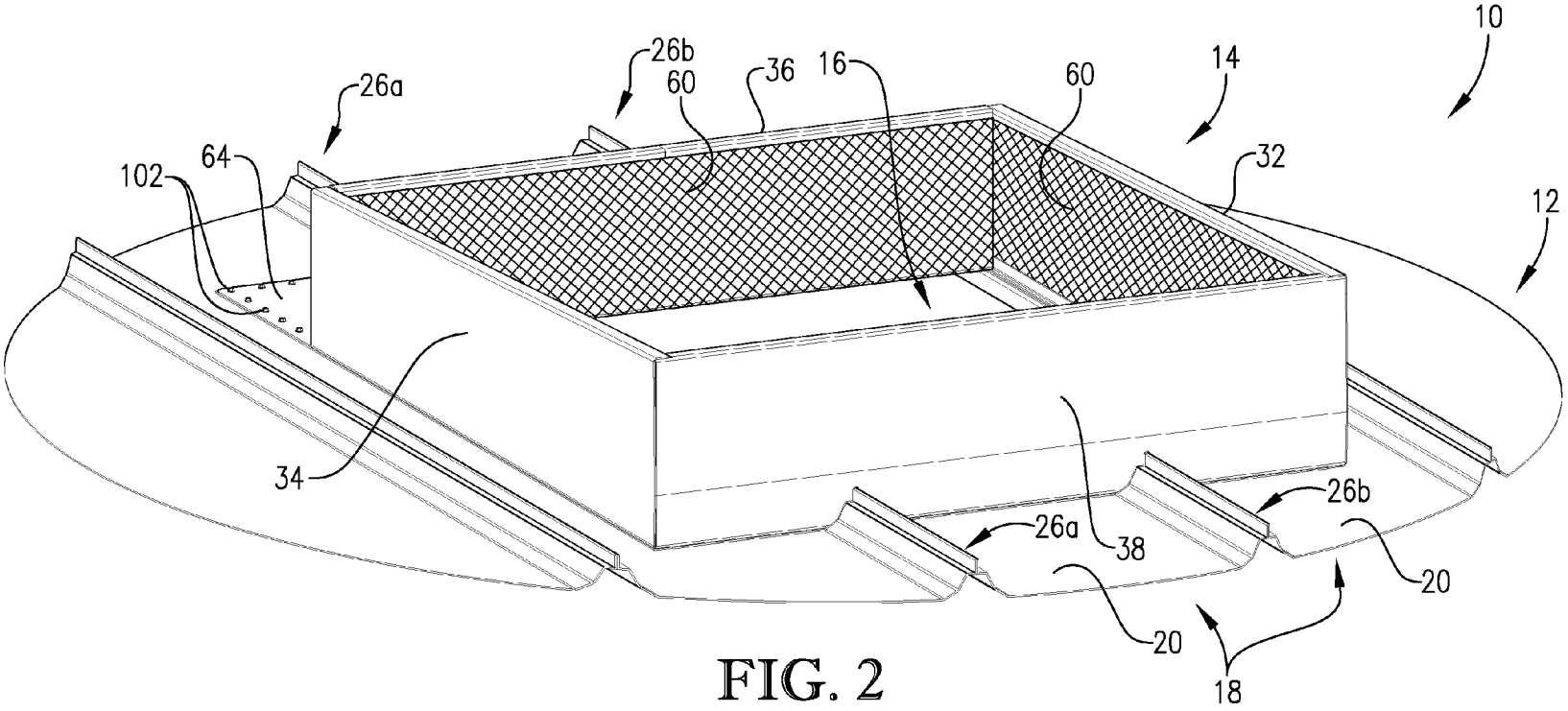
FIG. 2 is a perspective view similar to that of FIG. 1, but illustrating the lower end of the curb.
Figure 3:
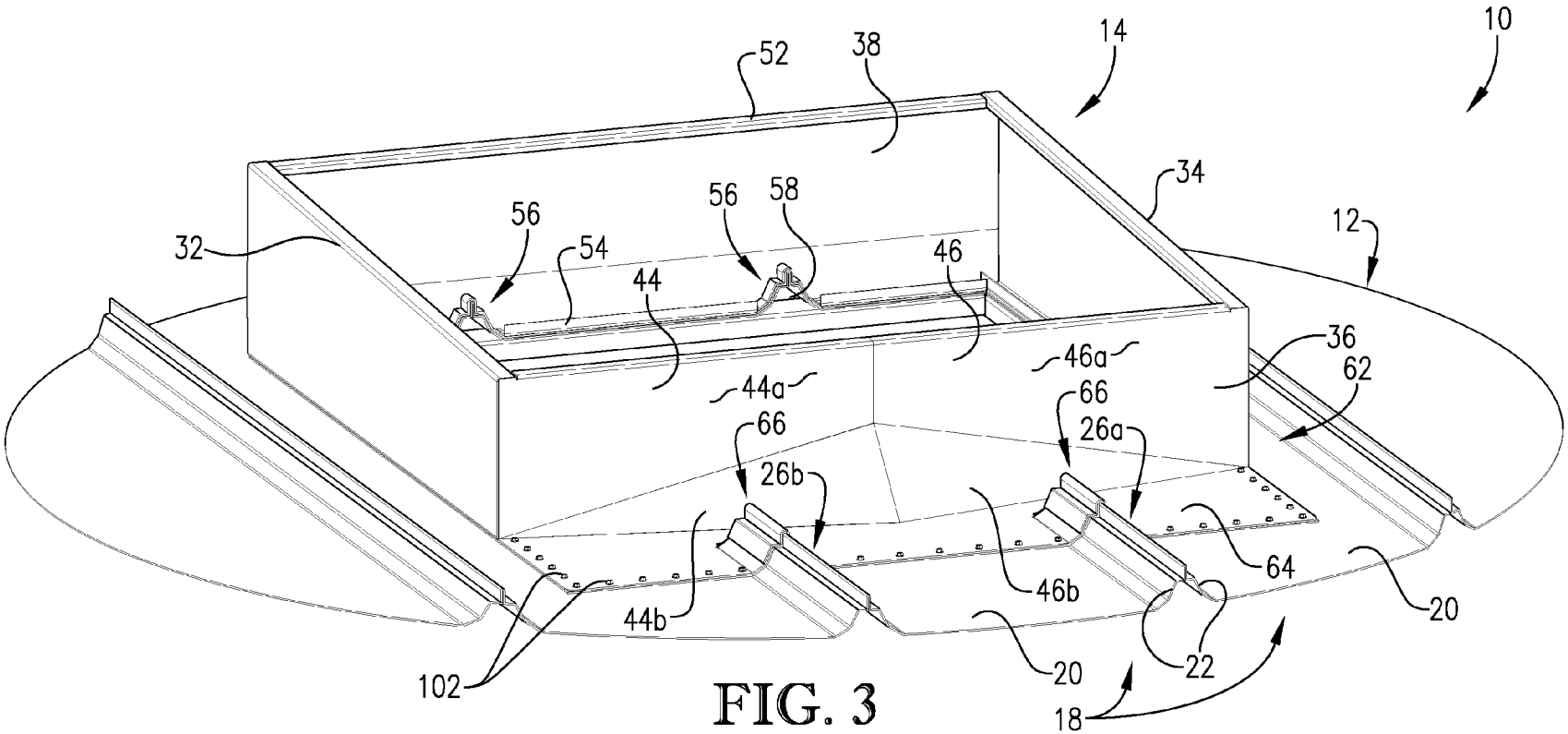
FIG. 3 is a perspective view with parts broken away of the curb, illustrating the higher end and lower end connection structure.

Turning now to the drawings, and particularly FIGS. 1-3, roof construction 10 is illustrated, broadly made up of a sloped, standing seam metal roof 12, and an integrally formed, prefabricated metallic curb assembly 14 mounted on the roof 12 and in surrounding relation to a quadrate roof opening 16. The assembly 14 is designed to support a roof fixture, such as an exhaust fan or skylight (not shown). Although the roof is preferably formed at least substantially of metal, it is within the ambit of the present invention for the roof to be formed of other suitable materials (such as composites, synthetic resin, etc.)

The roof 12 is itself conventional, and is made up of a plurality of elongated roof panels 18 each having a central web 20 and upstanding, side marginal, seam-defining walls 22. The panels 18 are in a sloped orientation, presenting a relatively higher upper end (not shown) and a relatively lower end (also not shown), with the panels 18 running lengthwise between the roof ends. This assures that rain water will be drained from the roof, such water traveling in the direction marked by arrow 24 (FIG. 1). During the construction of roof 12, the panels 18 are placed in side-by-side adjacency, with the walls 22 being in close proximity. Thereupon, a conventional seaming device is used to form substantially water-tight standing seams 26 along the lengths of the now-interconnected panels 18. In the illustrated embodiment, the standing seams 26 are generally trapezoidal in cross-sectional configuration, with each wall 22 having a lower, angularly oriented segment 22*a*, an upper segment 22*b* extending from the segment 22*a*, a flat top segment 22*c*, and an uppermost, upstanding seam-defining wall 22*d*. It will be appreciated that the illustrated seams 26 are intended to be generic, and thus do not illustrate any specific type of lapped configuration; in practice, of course, the configuration of any particular seam is dependent upon the type of seaming device employed.

Figure 8:
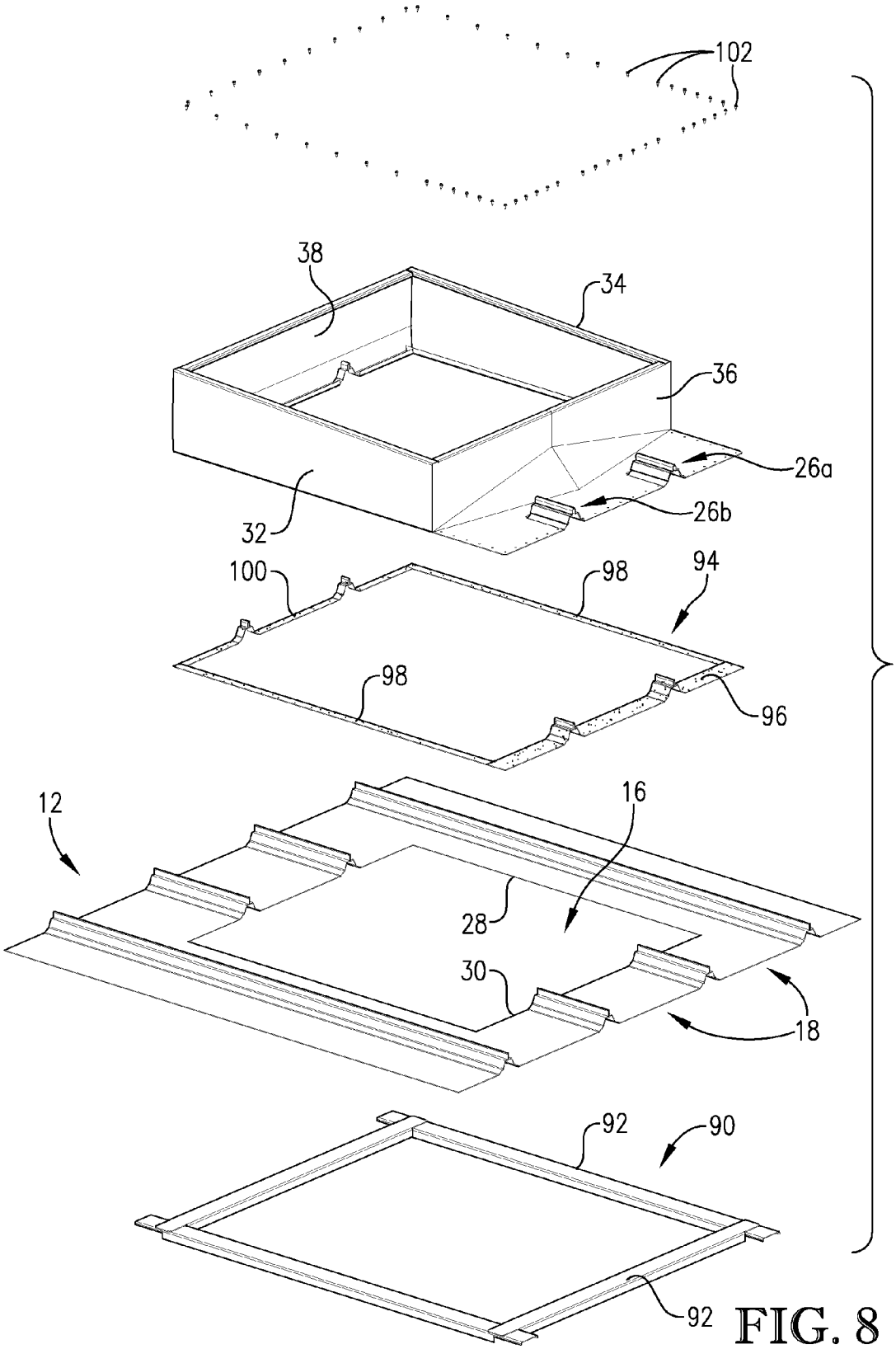
FIG. 8 is an exploded perspective view of the curb assembly of FIGS. 1-7.

The roof opening 16 is dimensioned to accommodate the desired roof fixture. In the illustrated embodiment, the opening 16 is generally quadrate (e.g., square or rectangular), with a fore-and-aft length 28 and a lateral length 30. Those of ordinary skill in the art will appreciate, however, that any suitable opening shape and size is within the ambit of the present invention. The lateral length 30 crosses at least one of the standing seams 26 and, in the particular embodiment shown, the length 30 crosses a pair of adjacent seams 26*a*, 26*b* (FIG. 8).

The curb assembly 14 is designed to be placed about the opening 16 and broadly includes upstanding, opposed sidewalls 32 and 34, a higher end lateral wall 36, and a lower end lateral wall 38 (the designations "higher" and "lower" being relative to the slope of the roof 12). In the illustrated embodiment, the walls 32-38 are welded or otherwise interconnected to form a box-like structure. It is noted that the walls 32-38 are arranged into a shape and size that corresponds to that of the roof opening 16, and this shape and size may be similarly varied without departing from the scope of the present invention. The sidewalls 32, 34 are preferably identical, and each has upper and lower, inwardly extending, generally U-shaped flanges 40, 42.

Figure 6:
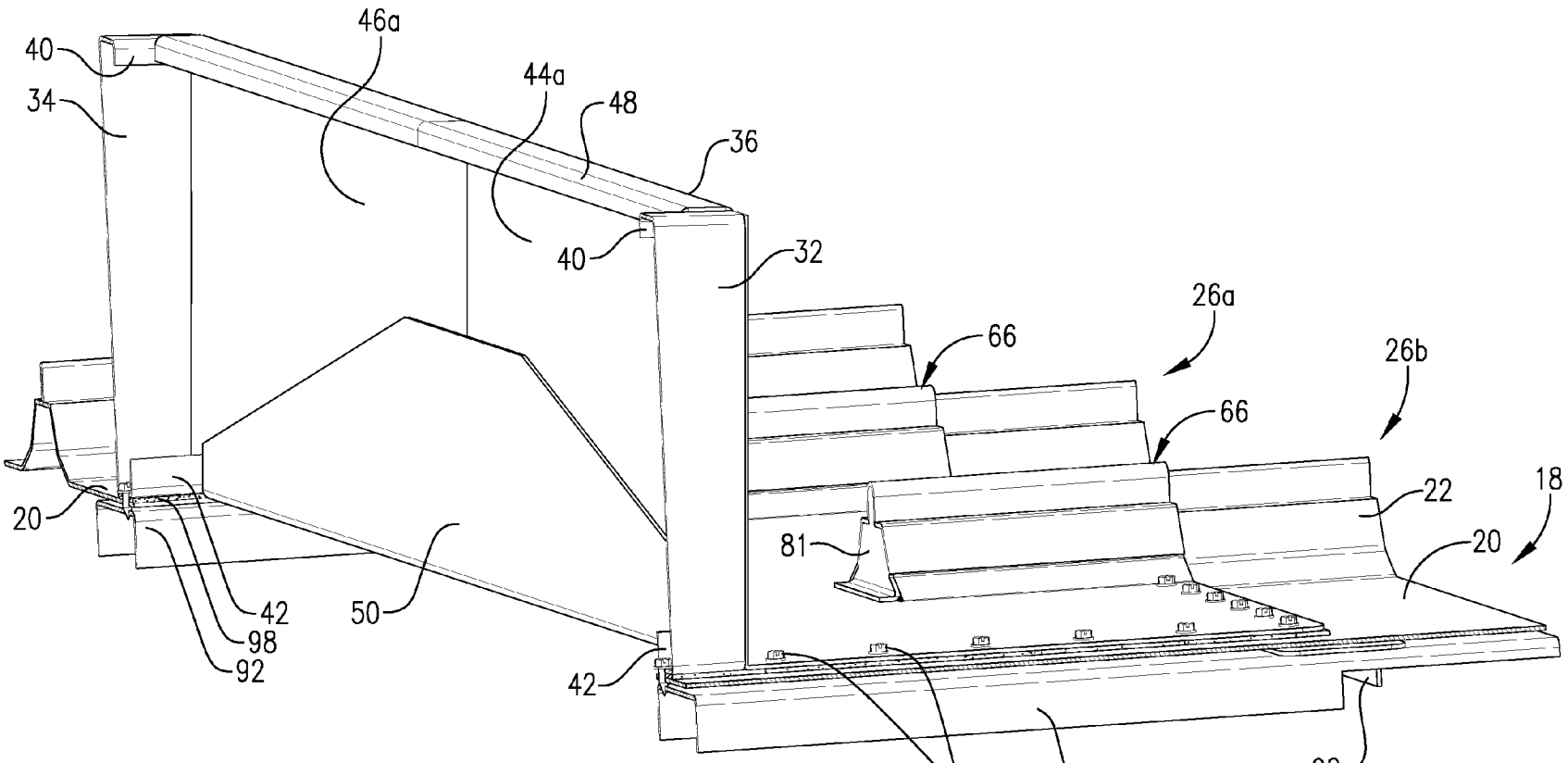
FIG. 6 is a fragmentary, perspective view illustrating the inner surface of the higher end lateral wall and the higher end connection structure.

The higher end lateral wall 36 is preferably fabricated from two welded-together mirror-image wall segments 44 and 46. Each such segment has a vertical segment 44*a*, 46*a*, as well as a triangularly shaped, outwardly extending segment 44*b*, 46*b* defining a hollow interior space below the segments 44*a*, 46*a* (not shown). Internally, the higher end lateral wall includes an upper, inwardly extending, U-shaped flange 48 and a trapezoidal gusset or liner 50 secured to the inner faces of the segments 44 and 46, thereby closing the hollow interior space (FIG. 6). The segments 44*b*, 46*b* cooperatively define a diverter for rain water (sometimes referred to in the art as a "cricket"). The cricket is configured to divert rain water laterally away from the curb assembly 14.

The lower end lateral wall 38 is equipped with an upper, inwardly extending, generally U-shaped flange 52, and a lower, opposed, inwardly extending U-shaped flange 54. However, it will be observed that the flange 54 has a pair of laterally spaced apart, upstanding, integral cap sections 56, which are important for purposes to be described. Moreover, the wall 38 has a pair of through-openings 58 which are identically configured and in registry with the respective cap sections 56.

Each of the walls 32-38 is provided with thermal insulation 60 throughout the lengths thereof, which may be fiberglass or some other suitable insulative material. In the case of the sidewalls 32, 34 and lower end lateral wall 38, the insulation extends between the opposed upper and lower flanges thereof. The insulation for higher end lateral wall 36 extends from the upper flange 48 downwardly to the bottom margin of the liner 50. In some instances, the insulation associated with the higher end lateral wall 36 is provided by the roof insulation, with such insulation being wrapped up into the curb assembly 14 against the liner 50.

The overall curb assembly 14 also includes higher end connection structure 62 secured to and extending from the lower margin of lateral wall 36. The structure 62 includes a flat plate 64 equipped with a pair of spaced apart caps 66, which are configured to mate with and cover the ends of the standing seams 26 crossed by the opening 16. Also, the lower edges of the segments 44*b*, 46*b* are welded to the plate 64.

Figure 4:
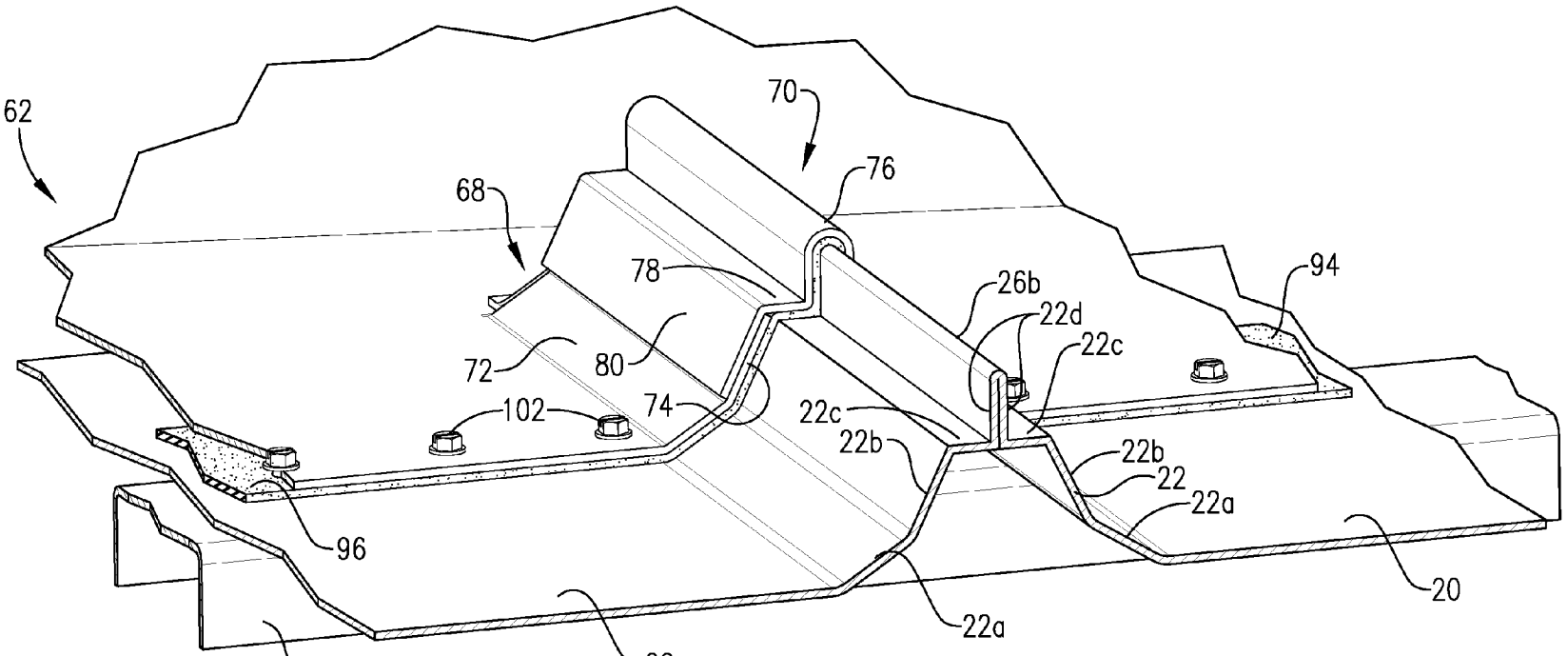
FIG. 4 is an enlarged, fragmentary view illustrating the higher end connection structure of the curb, and illustrating the details of the preferred seam cap.
Figure 5:
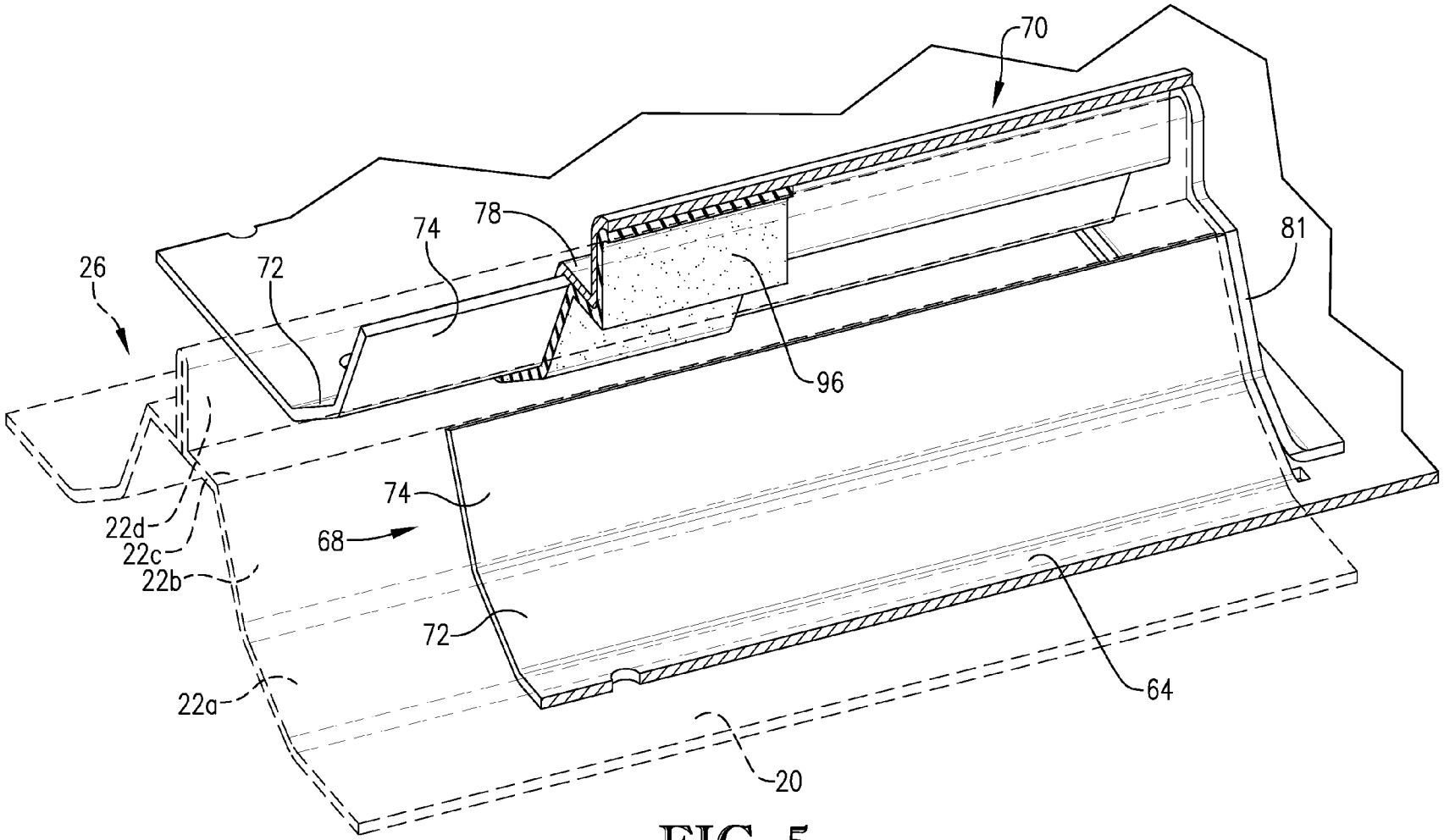
FIG. 5 is an enlarged, fragmentary, perspective view of the preferred seam cap, with the roof seam illustrated in phantom.

In detail, each cap 66 has a pair of opposed, converging sidewall sections 68 and a surmounting top cover 70 secured to the sections 68. As illustrated in FIG. 4, the sidewall sections 68 include a lower, inwardly extending, inclined wall 72 and an upper wall 74. The walls 72, 74 are designed to overlie and mate with the segments 22*a*, 22*b* described previously. The cover 70 has an upper section 76 configured to overlie and mate with the interconnected seam-defining walls 22*d*, lateral walls 78 designed to overlie and mate with the walls 22*c*, and downwardly extending walls 80 which overlie the walls 74. In practice, the walls 80 are spot- or tack-welded to the walls 74 in order to maintain the cover 70 in place. The lower ends of the caps 66 are provided with sealing plates 81, which are welded in place and designed to prevent passage of water into the interiors of the covered standing seams 26 (see FIGS. 5-6).

Figure 7:
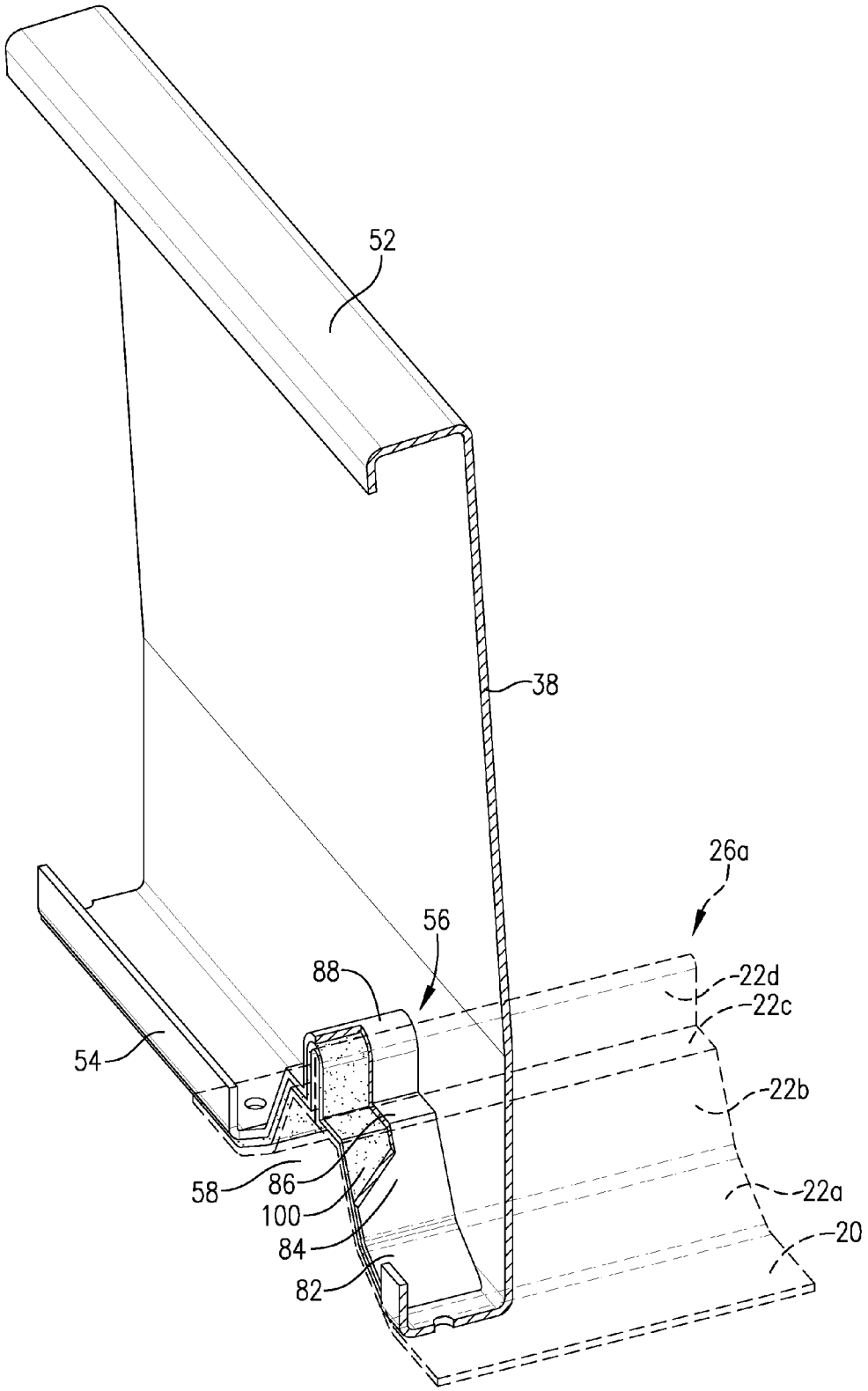
FIG. 7 is a fragmentary, perspective view illustrating the inner surface of the lower end lateral wall, particularly depicting the lower end connection structure of the curb, with the associated roof seam illustrated in phantom.

Assembly 14 is also equipped with lower end connection structure in the form of the internal cap sections 56 and openings 58. As best seen in FIG. 7, the cap sections 56 are welded to wall 38 and have wall sections configured to overlie and mate with the ends of the associated standing seams 26*a* and 26*b*. The cap sections 56 are integral and have lower wall segments 82 intermediate wall segments 84, lateral wall segments 86, and a top cover segment 88. The cap sections 56 are preferably integral with and form part of the bottom flange 54.

A lower, below-roof frame assembly 90 preferably also forms a part of curb assembly 14. As will be described, the frame assembly 90 is provided to facilitate connection of the curb assembly 14 to the roof 12. The frame assembly 90 is preferably designed to have a complemental shape and size to the roof opening 16. Therefore, in the illustrated embodiment, the frame assembly 90 presents a generally quadrate shape that is slightly larger than the roof opening 16. The preferred frame assembly 90 comprises four overlapped metallic channels 92 sized and oriented to lie beneath sidewalls 32, 34; the side margins of plate 64; and the lateral width of plate 64. The frame assembly 90 may be preassembled, or the bars 92 thereof can be individually mounted and attached, as described below.

The installation of curb assembly 14 is accomplished by initially applying sealant in the form of caulking tape 94 just inside the perimeter of the assembly 14. A relatively wide tape section 96 (e.g., formed by a pair of side-by-side tape strips) is applied across the undersides of the caps 66 and the adjacent stretches of the plate 64. Side marginal tape sections 98 are applied to the undersides of the lower sidewall flanges 42, and a tape section 100 is applied to the underside of the lower flange 54 (including the cap sections 56 thereof). Next, the upper box-like structure of curb assembly 14 is positioned on roof 12 so that the caps 66 overlie and mate with the ends of the seams 26*a* and 26*b* crossed by opening 16, and the cap sections 56 similarly overlie and mate with the opposed ends of these seams 26*a*, 26*b*. The frame assembly 90 is then supported beneath the roof 12 in alignment with the assembly 14. Threaded metal screws 102 are used to secure the assembly 14 in place, as illustrated in FIGS. 1-4 and 6, with the screws passing through the plate 64, lower flanges 42 and 54, roof 12, and the frame channels 92. Preferably, a continuous sealant bead (not shown), such as gun grade sealant, is applied about the entire perimeter of the curb assembly 14 between the roof 12 and the plate 64, between the roof 12 and each of the sidewalls 32 and 34, and between the roof 12 and the lower end lateral wall 38. The desired roof fixture can then be installed on the curb assembly 14 in the usual manner.

The curb assembly 14 is preferably metallic (except the sealing material), with the various components thereof preferably being welded to one another to provide a unitary, integrally formed structure. Those of ordinary skill in the art will appreciate that the curb assembly may be formed of other suitable materials (such as composites, synthetic resins, etc.), without departing from the spirit of the present invention.

The curb assembly 14 provides a number of significant advantages. First, the assembly 14 can be used with a variety of standing seam configurations. In the case of trapezoidal standing seams, it is only necessary to provide appropriately configured cap covers 70 which mate with the selected lap pattern of the seams. Moreover, where other types of standing seams are employed, it is only necessary to stamp the higher and lower end connection structure to provide a mating configuration.

The curb assemblies are also easy to install in the field, which reduces labor costs. Provision of prefabricated components, specifically designed for a given standing seam roof, eliminates the need to field-assemble and modify the curbs. The ease of installation also helps assure that the curbs are installed in a safe, water-tight fashion.

Although the above description presents features of preferred embodiments of the present invention, other preferred embodiments may also be created in keeping with the principles of the invention. Furthermore, these other preferred embodiments may in some instances be realized through a combination of features compatible for use together despite having been presented independently as part of separate embodiments in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention set forth in the following claims.

What is claimed is:

1. A roof construction comprising:

a sloped roof comprising a series of side-by-side panels interconnected along substantially parallel standing seams and presenting a higher end and a lower end whereby water will drain from the roof and off the lower end thereof;

an opening formed in the roof and having a lateral dimension transverse to the standing seams and crossing at least one of the standing seams; and a roof curb located on the roof in surrounding relationship to the opening, said roof curb being operable to support a roof fixture and including— a box-like structure formed from upright walls, said walls being welded to one another and including a pair of opposed sidewalls, a higher end lateral wall, and a lower end lateral wall, higher end connection structure extending at least in part from a bottom margin of the higher end lateral wall, said higher end connection structure including a plate, said plate including a substantially flat portion and an upstanding cap projecting relative to the flat portion, said upstanding cap being in mating, covering relationship with the at least one standing seam, said cap being integrally formed as part of the plate so as to be secured in the mating, covering relationship with the at least one seam without requiring the use of mechanical fasteners interconnected between the cap and the roof, said cap including a first inner section and an overlapping second section that overlaps at least part of the first section, a water diverter extending between the plate and the higher end lateral wall and being configured to divert water laterally away from the curb, and lower end connection structure, said box-like structure, the lower end connection structure, the higher end connection structure, and the water diverter being formed of metal and welded to one another so as to cooperatively form a prefabricated, unitary structure positioned on the roof.

2. The roof construction as claimed in claim 1, said plate and the higher end lateral wall being welded directly to one another.

3. The roof construction as claimed in claim 1, said lower end connection structure and said lower end lateral wall being welded directly to one another.

4. The roof construction as claimed in claim 1, said higher end lateral wall including an outwardly extending segment that at least partly defines the water diverter.

5. The roof construction as claimed in claim 1, said plate including an end plate covering a lower end of the cap.

6. The roof construction as claimed in claim 5, said substantially flat portion of the plate projecting higher along the panel than the lower end of the cap.

7. The roof construction as claimed in claim 6, said flat portion of the plate extending at least as high as an upper end of the cap.

8. The roof construction as claimed in claim 1, said opening in the roof having a lateral dimension crossing a plurality of said standing seams, said curb assembly having a corresponding number of caps, each of said seams crossed by the opening presenting a lower margin, said flat portion of the plate being located at least in part between adjacent ones of the seams, said flat portion of the plate extending higher than the lower margins of the adjacent ones of the seams.

9. The roof construction as claimed in claim 8, said flat portion of the plate being located at least in part between a pair of the caps, said flat portion of the plate projecting higher along the panel than lower ends of the caps.

10. The roof construction as claimed in claim 9, said flat portion of the plate extending at least as high as upper ends of the caps.

11. The roof construction as claimed in claim 9, said plate including an end plate covering the lower end of each of the caps.

12. The roof construction as claimed in claim 1, said plate including a spaced apart pair of opposed, converging sidewall sections that partly define the cap.

13. The roof construction as claimed in claim 12, said cap including a top cover spanning the sidewall sections, said first section of the cap comprising the sidewall sections, said second section of the cap comprising the top cover.

14. The roof construction as claimed in claim 13, said plate including an end plate covering a lower end of the cap, said sidewall sections, top cover, and end plate being welded to one another.

15. The roof construction as claimed in claim 1, said water diverter comprising a pair of interconnected, generally triangular plate segments welded to the higher end lateral wall and the plate and defining a hollow region.

16. The roof construction as claimed in claim 15, said curb including a liner welded to an inner face of the higher end lateral wall and configured to separate the hollow region from the interior of the curb.

17. The roof construction as claimed in claim 1, further including:

a frame adjacent the underside of the roof and in general alignment with the plate and sidewalls, there being threaded connectors passing through the plate, panels, and the frame.

18. The roof construction as claimed in claim 1, said lower end connection structure comprising a cap section in mating, covering relationship with the at least one standing seam, said cap section being located adjacent a bottom margin of the lower end lateral wall, there being an opening formed in the lower end lateral wall in registry with the cap section in order to receive the at least one standing seam.

19. The roof construction as claimed in claim 18, said lower end connection structure including an inwardly extending bottom flange adjacent the bottom margin of the lower end lateral wall, said bottom flange of the lower end lateral wall and the cap section being unitary.

20. The roof construction as claimed in claim 18, further including:

sealing material between the lower surfaces of the plate and cap section, and the adjacent surfaces of said at least one standing seam, said sealing material being between the higher end of said plate and the panel portions therebeneath, said sidewalls and the lower end lateral wall each including an inwardly extending bottom flange adjacent the bottom margin thereof, said sealing material being between the bottom flange and the panel portions therebeneath.

* * * * *